US012543858B2

(12) United States Patent
Toporowski

(10) Patent No.: US 12,543,858 B2
(45) Date of Patent: Feb. 10, 2026

(54) FLEXIBLE SLIDE FOR NECK AND HEAD SUPPORT

(71) Applicant: David Toporowski, Burlington, NJ (US)

(72) Inventor: David Toporowski, Burlington, NJ (US)

( * ) Notice: Subject to any disclaimer, the term of this patent is extended or adjusted under 35 U.S.C. 154(b) by 0 days.

(21) Appl. No.: 18/587,862

(22) Filed: Feb. 26, 2024

(65) Prior Publication Data

US 2025/0268382 A1 Aug. 28, 2025

(51) Int. Cl.
*A47C 7/38* (2006.01)

(52) U.S. Cl.
CPC ..... *A47C 7/383* (2013.01)

(58) Field of Classification Search
CPC ..... A47C 7/38; A47C 7/383; A47C 7/425
See application file for complete search history.

(56) References Cited

U.S. PATENT DOCUMENTS

| | | | | |
|---|---|---|---|---|
| 7,908,692 | B2 | 3/2011 | Lange | |
| 9,409,500 | B2 * | 8/2016 | Bailey | B60R 22/14 |
| 9,833,025 | B2 | 12/2017 | Knapp | |
| 11,166,564 | B2 * | 11/2021 | Simhan | A47C 7/405 |
| 2008/0197688 | A1 * | 8/2008 | Tate | A47C 31/126 297/464 |
| 2015/0274044 | A1 | 10/2015 | Kreppein | |
| 2021/0007477 | A1 | 1/2021 | Hill et al. | |

* cited by examiner

*Primary Examiner* — Nicholas McFall
(74) *Attorney, Agent, or Firm* — Kattina V Barsik, Esq.

(57) ABSTRACT

Disclosed is a comfort device for head and neck support. The comfort device includes a slide panel having first and second panel ends. The comfort device further includes a pad attached to the first panel end of the slide panel. The pad has first and second pad ends such that (i) the first pad end is fixedly attached to a first surface of the slide panel to form a through cavity and (ii) the second pad end is a free end. Further, the comfort device includes a first band that is inserted into the through cavity. Furthermore, the comfort device includes a second band that is attached to the first and second panel ends.

14 Claims, 14 Drawing Sheets

FLEXIBLE SLIDE FOR NECK AND HEAD SUPPORT

BACKGROUND

The present disclosure relates generally to a personal device, and more particularly, to a comfort device for head and neck support.

In today's world, we frequently find ourselves seated for work, travel, play and leisure. Often the chairs provided for these activities offer little in comfort or stability. Many times we are placed in seats that do not support our spines, neck, head or shoulders properly, creating ergonomic hazards. Combine this with the necessity to concentrate at work (i.e. computing), or play (i.e., gaming), we generally neglect to sit properly, repeatedly slouching our neck and spines and rolling our shoulders forward. Conversely, when sitting to relax (travel, mediation, recovery), we sometimes lose our natural bodily support from our neck muscles, and the head can nod awkwardly frontward. Poor sitting posture can cause problems with spinal alignment and reoccurring pain in the muscles of the neck and shoulders. It is thus critical to keep the body comfortable and stable for optimal performance and/or relaxation while sitting in the seats provided.

Generally, available comfort devices support the neck and head of a user in such way that they rest in a fixed, natural position allowing the muscles and in particular the spine to relax, with rigid elongated cylindrical members. Such devices generally have complicated structure and are quite heavy such that carrying such devices is extremely difficult. Moreover, such devices are designed to be carried by a user around the neck, which makes using such devices very uncomfortable for the user for a long period of time, and therefore negates the purpose of such devices. Moreover, such devices are rigid and are not compatible for seats and/or chairs with different specifications and dimensions. Some other available devices claim to provide a support to the spine and neck of a user for an appropriate seating posture of the user. Such devices are commonly worn wrapping the body of the user like a jacket or a confining structure. However, such devices restrict the flexible movement of the body of a user and commonly are very uncomfortable to be worn for a long-time span. Furthermore, such devices lack appropriate comfort that can provide a user an ease-of usage with a simplicity of form and are not specific to only a particular functionality (i.e., relaxation or support to the neck and spine) and have a multi-functional aspect of usage.

Thus, there is a need for a technical solution that overcomes the aforementioned problems of conventional devices designed for comfort of a user.

SUMMARY

In an embodiment of the present disclosure, a comfort device for head and neck support is disclosed. The comfort device includes a slide panel having first and second panel ends. The comfort device further includes a pad attached to the first panel end of the slide panel. The pad has first and second pad ends such that (i) the first pad end is fixedly attached to a first surface of the slide panel to form a through cavity and (ii) the second pad end is a free end. Further, the comfort device includes a first band that is inserted into the through cavity. Furthermore, the comfort device includes a second band that is attached to the first and second panel ends.

In some embodiments of the present disclosure, the first panel end and the second panel end comprising a first panel hole and a second panel hole, respectively, such that the second band is attached to the first and second panel ends by way of the first and second panel holes, respectively.

In some embodiments of the present disclosure, the slide panel is made up of Acrylonitrile butadiene styrene (ABS) plastic material.

In some embodiments of the present disclosure, the slide panel has (i) a thickness of 0.125 inches, (ii) a length (L1) in a range of 12 inches to 18 inches, and (iii) a width (W1) in a range of 3 inches to 5 inches.

In some embodiments of the present disclosure, the slide panel has rounded edges.

In some embodiments of the present disclosure, the pad is made up of a high-density cellulose material.

In some embodiments of the present disclosure, the pad has an inner diameter (ID) and an outer diameter (OD) such that the inner diameter (ID) is less than the outer diameter (OD).

In some embodiments of the present disclosure, the inner diameter (ID) is in a range of 1.5 inches to 2 inches and the outer diameter is in a range of 3 inches to 3.5 inches.

In some embodiments of the present disclosure, the pad has a width (W2) that is in a range of 3 inches to 5 inches.

In some embodiments of the present disclosure, the first band has a tapering width in a range of 2 inches to 4 inches and a length in a range of 25 inches to 35 inches.

In some embodiments of the present disclosure, the pad has a cutout that is formed between the first and second pad ends such that the cutout is adapted to receive the first panel end for attaching the slide panel to the pad.

In some embodiments of the present disclosure, the first hand comprising first and second ends such that the first and second ends, when attached to one another form a closed loop.

In some embodiments of the present disclosure, the comfort device further comprising an attachment adapted to (i) attach the first and second ends of the first band and (ii) enable an adjustment of a diameter of the closed loop.

In some embodiments of the present disclosure, a weight of the comfort device is in a range of 0.5 ounces to 0.6 ounces.

BRIEF DESCRIPTION OF THE DRAWINGS

The following detailed description of the preferred embodiments of the present disclosure will be better understood when read in conjunction with the appended drawings. The present disclosure is illustrated by way of example, and not limited by the accompanying figures, in which, like references indicate similar elements.

DETAILED DESCRIPTION

The detailed description of the appended drawings is intended as a description of the currently preferred embodiments of the present disclosure and is not intended to represent the only form in which the present disclosure may be practiced. It is to be understood that the same or equivalent functions may be accomplished by different embodiments that are intended to be encompassed within the spirit and scope of the present disclosure.

Figure 1A:
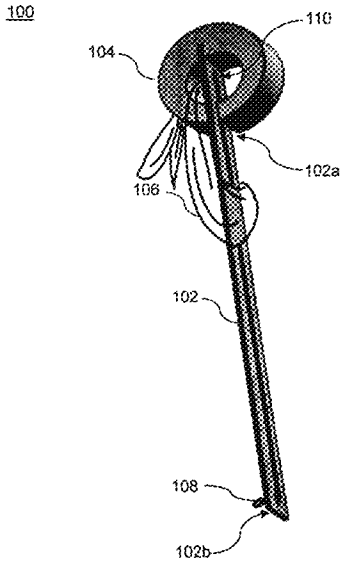
FIG. 1A illustrates a side view of a comfort device for head and neck support, according to an embodiment of the present disclosure.

FIG. 1A illustrates a side view of a comfort device 100 for head and neck support, according to an embodiment of the present disclosure. The comfort device 100 may be an easy to use and simple device. Further, the comfort device 100 may have multifunctional uses such as, but not limited to, travel, meditation, gaming, and recovery. The comfort device 100 may include a slide panel 102, a pad 104, a first band 106, and a second band 108 (as shown later in FIG. 1B). The comfort device 100 may be designed in such a way that each component (i.e., the slide panel 102, the pad 104, the first band 106, and the second band 108) is flexible and supportive in way that provides restful comfort for a back, a neck, and a head of a user using the comfort device 100. Further, each component (i.e., the slide panel 102, the pad 104, the first band 106, and the second band 108) is hand washable.

The slide panel 102 may be a flat structure with a substantially rectangular shape. The slide panel 102 may include a first panel end 102*a* and a second panel end 102*b*. In some embodiments of the present disclosure, the slide panel 102 may have rounded edges. Specifically, the rounded edges of the slide panel 102 may enable safe usage of the comfort device 100. In some embodiments of the present disclosure, the slide panel 102 may be made up of Acrylonitrile butadiene styrene (ABS) plastic material. The slide panel 102 made up of the ABS plastic material may provide a flexibility to the slide panel 102 such that the slide panel 102 can adjust to individual shapes and forms of a neck, back, and head of a user using the comfort device 100. Embodiments of the present disclosure are intended to include and/or otherwise cover any type of the material for the slide panel 102 that may facilitate the slide panel 102 to serve one or more similar functionalities as served by the slide panel 102 made up of the ABS plastic material, without deviating from the scope of the present disclosure.

The pad 104 may have a substantially circular shape. The pad 104 may be attached to the first panel end 102*a* of the slide panel 102 such that when attached, the pad 104 and the slide panel 102 forms a through cavity 110. Specifically, the pad 104 may be adapted to provide cushioning to the neck and/or a rear lower skull of the user using the comfort device 100. In some embodiments of the present disclosure, the pad 104 may be made up of a high-density cellulose foam. In some other embodiments of the present disclosure, the pad 104 may be made up of a memory foam. Embodiments of the present disclosure are intended to include and/or otherwise cover any type of the soft compressible material for the pad 104 that may facilitate the pad 104 to serve one or more similar functionalities as served by the pad 104 made up of the high-density cellulose foam and/or the memory foam, without deviating from the scope of the present disclosure.

The first band 106 may be a fabric band that may be removably attached to the slide panel 102 when the pad 104 may be attached to the first panel end 102*a* of the slide panel 102. Specifically, the first band 106 may be inserted into the through cavity 110 formed by the attachment of the pad 104 and the slide panel 102. The first band 106 may be adapted to be pulled over forehead of the user using the comfort device 100 such that the first band 106 acts as a sling in which the head of the user can rest.

Figure 1B:
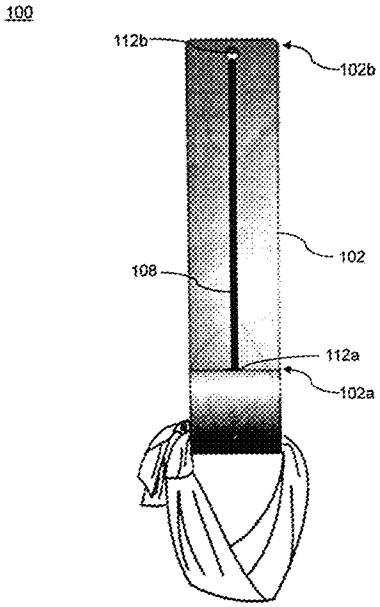
FIG. 1B illustrates a front view of the comfort device, according to an embodiment of the present disclosure.

FIG. 1B illustrates a front view of the comfort device 100, according to an embodiment of the present disclosure. As discussed, the comfort device 100 may include the second band 108. The second band 108 may be an elastic braided band that may be attached to the first and second panel ends 102*a* and 102*b* of the slide panel 102. Specifically, the second band 108 may be attached along a length of the slide panel 102 thus creating a shoulder harness that facilitates the user to carry the comfort device 100. In some embodiments of the present disclosure, the slide panel 102 may have a first hole 112*a* and a second hole 112*b* at the first panel end 102*a* and the second panel end 102*b* of the slide panel 102, respectively. The second band 108 may be attached to the slide panel 102 at the first and second panel ends 102*a* and 102*b* by way of the first and second holes 112*a* and 112*b*, respectively. In other words, the second band 108 may be inserted and tied within the first and second holes 112*a* and 112*b* of the slide panel 102 such that the second band 108 runs along a length of the slide panel 102 between the first and second holes 112*a* and 112*b*.

Figure 1C:
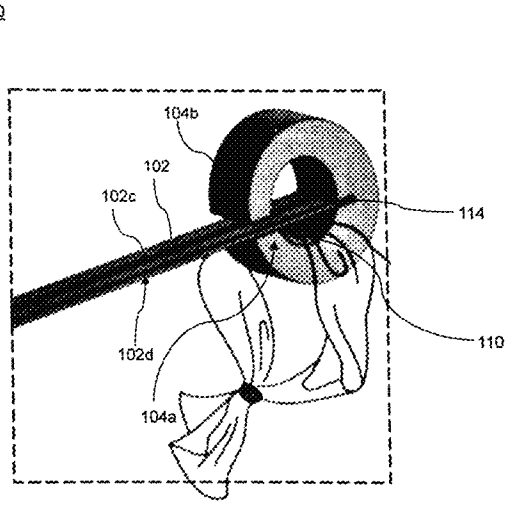
FIG. 1C illustrates an enlarged partial view of the comfort device, according to an embodiment of the present disclosure.

FIG. 1C illustrates an enlarged partial view of the comfort device 100, according to an embodiment of the present disclosure. The slide panel 102 may have a first surface 102*c* and a second surface 102*d*. Specifically, the second band 108 may be inserted and tied within the first and second holes 112*a* and 112*b* (as shown in FIG. 18) of the slide panel 102 such that the second band 108 runs along the length of the slide panel 102 between the first and second holes 112*a* and 112*b* on the first surface 102*c*. The pad 104 may be a circular shaped pad. The pad 104 may have first and second pad ends 104*a* and 104*b*. The pad 104 further includes a cutout 114 formed between the first and second pad ends 104*a* and 104*b* of the pad 104. In some embodiments of the present disclosure, the cutout 114 may be formed equidistant from the first and second pad ends 104*a* and 104*b* of the pad 104 (i.e., at a center of the pad 104). Specifically, the cutout 114 may be adapted to receive the first panel end 102*a* of the slide panel 102 when the slide panel 102 is attached to the pad 104 to form the comfort device 100 (i.e., an e-shaped structure). The first pad end 104*a* of the pad 104 may be fixedly attached to the first surface 104*a* of the slide panel 102. In some embodiments of the present disclosure, the first pad end 104*a* of the pad 104 may be fixedly attached to the first surface 104*a* of the slide panel 102 by way of an adhesive. The adhesive may include, but is not limited to, an epoxy, an adhesive tape, and the like. Embodiments of the present disclosure are intended to include and/or otherwise cover any type of the adhesive, known to a person having ordinary skill in the art, without deviating from the scope of the present disclosure. Further, the second pad end 104*b* of the slide panel 102 may be a free end (i.e., not attached to the slide panel 102) to allow for compression and decompression of the pad 104 in response to a weight of the head of the user using the comfort device 100. The first pad end 104*a* of the pad 104 fixedly attached to the first surface 104*a* of the slide panel 102 to form the through cavity 110. In some embodiments of the present disclosure, the first band 106 may be removably attached to the slide panel 102 by way of the through cavity 110.

Figure 1D:
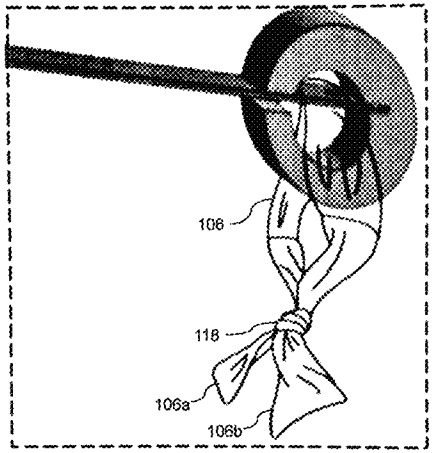
FIG. 1D illustrates another enlarged partial view of the comfort device, according to an embodiment of the present disclosure.

FIG. 1D illustrates another enlarged partial view of the comfort device 100, according to an embodiment of the present disclosure. As illustrated, the first band 106 may have first and second ends 106*a* and 106*b* such that the first and second ends 106*a* and 106*b* of the first band 106 may be attached to one another by way of an attachment 118. In some embodiments of the present disclosure, the attachment 118 may include, but is not limited to, a flexible band, a clip, and the like, Embodiments of the present disclosure are intended to include and/or otherwise cover any type of the attachment 118 that may enable a releasable coupling of the first and second ends 106*a* and 106*b* of the first band 106 to form a closed loop 120. Further, as the comfort device 100 can be used by anyone, therefore, the first band 106 needs to be an adjustable and/or a stretchable band to fit different sizes of heads of different users. In an embodiment of the present disclosure, the adjustability and/or stretchability of the first band 106 may be achieved by way of the attachment 118. Specifically, the attachment 118 to achieve adjustability and/or stretchability of the first hand 106 may be an elastic loop. The elastic loop may be adapted to attach the first and second ends 106*a* and 106*b* of the first band 106 to one another such that the clastic loop (i.e., the attachment 118) facilitate in adjusting a diameter of the closed loop 120 formed by the first band 106 to enable easy fitting of the first band 106 around a head of a user comfortably. In some aspects of the present disclosure, the elastic loop may be made up of a material such as, but not limited to, rubber, an elastic fabric, and the like. Embodiments of the present disclosure are intended to include and/or otherwise cover any type of material for the elastic loop, know to a person having ordinary skill in the art, without deviating from the scope of the present disclosure. In another embodiment of the present disclosure, the adjustability and/or stretchability of the first band 106 may be achieved by doubling the fabric of the first band 106. Embodiments of the present disclosure are intended to include and/or otherwise cover any type of arrangement to adjust the stretchability of the first band 106, know to a person having ordinary skill in the art, without deviating from the scope of the present disclosure.

Figure 2A:
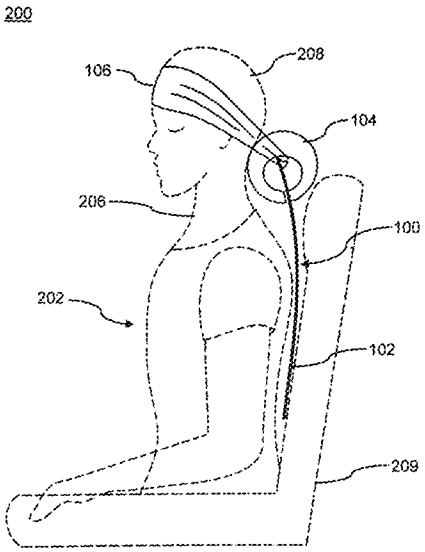
FIG. 2A illustrates a side perspective view of a user wearing the comfort device in an airplane with the eyes uncovered, according to an embodiment of the present disclosure.

The first band 106 may be adapted to be pulled over the forehead by a user using the comfort device 100 such that the first band 106, when engaged with the forehead of the user, acts as a hammock for the head of the user. The first band 106 in such configuration may allow a slight movement of the head by the user while providing steady and controlled comfort. In some embodiments of the present disclosure, the first band 106 may be adapted to be utilized as an eyeshade by the user using the comfort device 100 (as shown in FIG. 2A). In some embodiments of the present disclosure, the first band 106 may have a length in a range of 25 inches to 35 inches. Preferably, the length of the first band may be 30 inches. The first band 106, by virtue of a material that is used to for the first band 106, may be stretched to a length of 35 inches. Further, the first band 106 may have a tapering width in a range of 2 inches to 4 inches. In some embodiments of the present disclosure, the first band 106 may be made up of a material such as, but not limited to, polyester blend, polyester, and the like. Embodiments of the present disclosure are intended to include and/or otherwise cover any type of the material for the first band 106 that enables stretchability of the first band 106 as discussed above, known to a person having ordinary skill in the art, without deviating from the scope of the present disclosure.

Figure 1E:
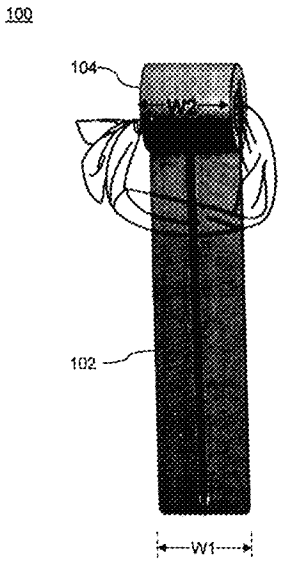
FIGS. 1E-1G illustrate different views of the comfort device, according to an embodiment of the present disclosure.
Figure 1F:
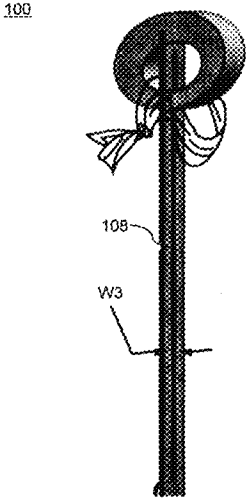
Figure 1G:
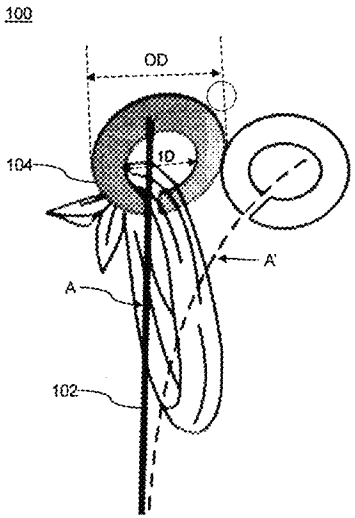

FIGS. 1E-1G illustrate different views of the comfort device 100, according to an embodiment of the present disclosure. As illustrated in FIGS. 1E and 1F, the slide panel 102 may have a width (W1) in a range of 3 inches to 5 inches. Preferably, the width (W1) of the slide panel 102 may be 4 inches. Similarly, the pad 104 may have a width (W2) that may be in a range of 3 inches to 5 inches, Preferably, the width (W2) of the pad 104 may be 4 inches. In other words, the width (W1) of the slide panel 102 and the width (W2) of the pad 104 may be substantially similar. The second band 108 may have a width (W3) in a range of 0.25 inches to 0.5 inches. Preferably, the width (W3) may be 0.375 inches.

Referring to FIG. 1G, the pad 104 may have an oblong opened shape. The pad 104 may have an inner diameter (ID) and an outer diameter (OD). Specifically, the inner diameter (ID) of the pad 104 may be less than the outer diameter (OD). In some embodiments of the present disclosure, the inner diameter (ID) may be in a range of 1.5 inches to 2 inches. Preferably, the inner diameter (ID) may be 1.75 inches. In some embodiments of the present disclosure, the outer diameter (OD) may be in a range of 3 inches to 3.5 inches. Preferably, the outer diameter (OD) may be 3.25 inches. Further, the slide panel 102 may be flexible such that the slide panel 102 can adjust to individual shapes and forms of the back of the user using the comfort device 100. As illustrated, when a user wears the comfort device 100, the slide panel 102 rests against a back of the user and can adjust to individual shapes and forms of the back of the user. Specifically, the slide panel 102 may rest against the back of the user in one of, a non-flexed position A and a flexed position A' while adjusting to individual shapes and forms of the back of the user.

Figure 1H:
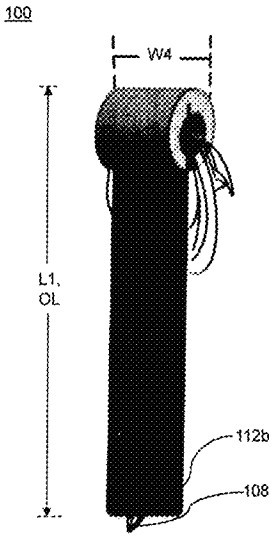
FIG. 1H illustrate a rear view of the comfort device, according to an embodiment of the present disclosure.

FIG. 1H illustrates a rear view of the comfort device 100, according to an embodiment of the present disclosure. The second band 108 that may be inserted and tied within the first and second holes 112*a* (as shown in FIG. 1B) and 112*b* may be looped at the second holes 112*a* to allow clipping the comfort device 100 onto, but not limited to, a backpack, luggage, and the like. Specifically, the second band 108 may be inserted through the second hole 112*b* and looped towards the second surface 102*b* of the slide panel 102. In some embodiments of the present disclosure, the slide panel 102 may have a length (L1) that may be in a range of 12 inches to 18 inches. Preferably, the length (L1) of the slide panel 102 may be 16 inches. The comfort device 100 may have an overall length (OL) in a range of 12 inches to 18 inches. Preferably, the overall length (OL) of the slide panel 102 may be 16 inches. Further, the comfort device 100 may have a width (W4) that may be in a range of 3 inches to 5 inches. Preferably, the width (W4) of the comfort device 100 may be 4 inches. Furthermore, the comfort device 100 may have a weight that may be in a range of 0.5 ounces to 0.6 ounces. Preferably, the weight of the comfort device 100 may be 0.58 ounces. Specifically, the comfort device 100 may be an extremely light weight device that facilitates to provide a comfortable position for rest and relaxation for a user.

FIG. 2A illustrates a side perspective view 200 of a user 202 wearing the comfort device 100 in an airplane with the eyes uncovered, according to an embodiment of the present disclosure. When the user 202 wears the comfort device 100 in an airplane, the slide panel 102 may rest against a back 204 of the user 202. Further, the pad 104 and the first band 106 may be adapted to provide a restful comfort to a neck 206 and a head 208, respectively, of the user 202. In an exemplary scenario, while travelling, the user 202 may place the slide panel 102 between the back 204 and a seat 209 on which the user 202 may be sitting. The slide panel 102 may be flexible such that the slide panel 102 can adjust to individual shapes and forms of the back of the user using the comfort device 100 while sitting on the seat 209 in an airplane with the eyes uncovered. The user 202 can further hook the first band 106 over a forehead 212 to use and enjoy a comfortable position for rest, relaxation, and/or napping on the seat 209.

Figure 2B:
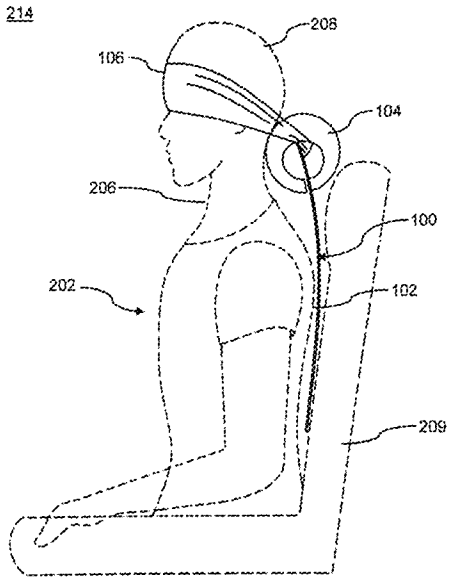
FIG. 2B illustrates another side perspective view of the user wearing the comfort device in an airplane with the eyes covered, according to another embodiment of the present disclosure.

FIG. 2B illustrates another side perspective view 210 of the user 202 wearing the comfort device 100 in an airplane with the eyes covered, according to another embodiment of the present disclosure. When the user 202 wears the comfort device 100, the slide panel 102 may rest against the back 204 of the user 202. Further, the pad 104 and the first band 106 may be adapted to provide a restful comfort to the neck 206 and the head 208, respectively, of the user 202. In an exemplary scenario, while travelling in an airplane, the user 202 may place the slide panel 102 between the back 202 and the seat 209 on which the user 202 may be sitting. The slide panel 102 may be flexible such that the slide panel 102 can adjust to individual shapes and forms of the back of the user using the comfort device 100 while sitting on the seat. 209 in an airplane with the eyes covered. The user 202 can further hook the first band 106 over the eyes to use the first band 106 as an eyeshade and enjoy a comfortable position for rest and relaxation while sitting on the seat 209.

Figure 2C:
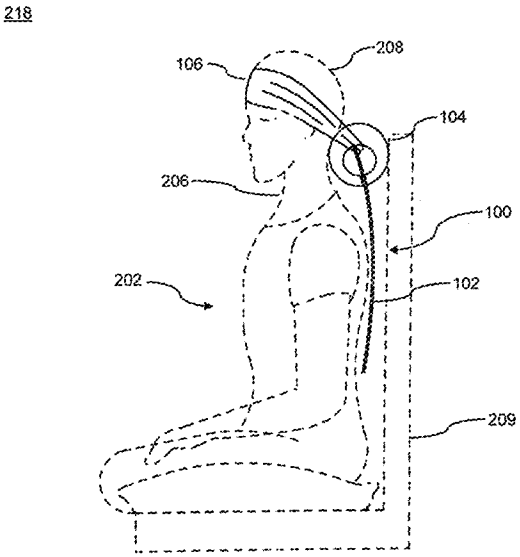
FIG. 2C illustrates another side perspective view of the user wearing the comfort device in a meditation position, according to another embodiment of the present disclosure.

FIG. 2C illustrates another side perspective view 218 of the user wearing the comfort device 100 in a meditation position, according to another embodiment of the present disclosure. When the user 202 wears the comfort device 100 and sits in the meditation position, the slide panel 102 may rest against the back 204 of the user 202. Further, the pad 104 and the first band 106 may be adapted to provide a restful comfort to the neck 206 and the head 208, respectively, of the user 202. In an exemplary scenario, while meditating, the user 202 may place the slide panel 102 between the back 204 and the seat 209 on which the user 202 may be sitting. The slide panel 102 may be flexible such that the slide panel 102 can adjust to individual shapes and forms of the back of the user using the comfort device 100 while sitting on the seat 209. The user 202 can further hook the first band 106 over the eyes to use the first band 106 as an eyeshade, and enjoy a comfortable position for meditation while sitting on the seat 209.

Figure 2D:
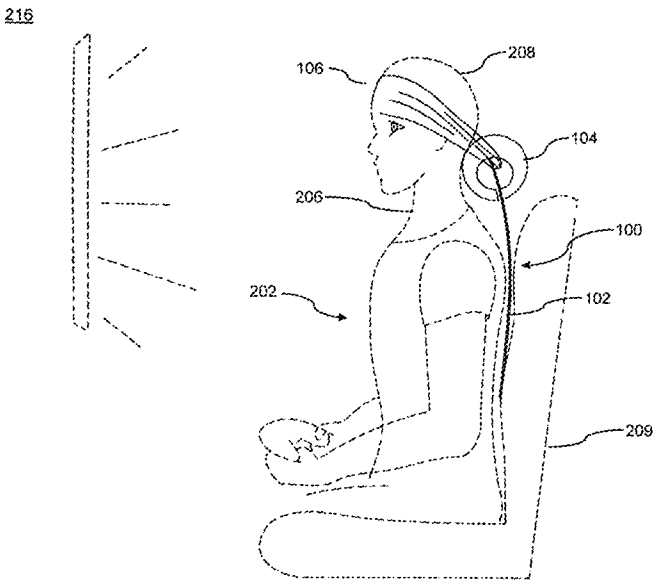
FIG. 2D illustrates another side perspective view of the user wearing the comfort device in a gaming and/or computing position, according to another embodiment of the present disclosure.

FIG. 2D illustrates another side perspective view 216 of the user wearing the comfort device 100 in a gaming and/or computing position, according to another embodiment of the present disclosure. When the user 202 wears the comfort device 100 in the gaming and/or computing position, the slide panel 102 may rest against the back 204 of the user 202. Further, the pad 104 and the first band 106 may be adapted to provide a restful comfort to the neck 206 and the head 208, respectively, of the user 202. In an exemplary scenario, while gaming and/or computing, the user 202 may place the slide panel 102 between the back 202 and the seat 209 on which the user 202 may be sitting. The slide panel 102 may be flexible such that the slide panel 102 can adjust to individual shapes and forms of the back of the user using the comfort device 100 while sitting on the seat 209 in the gaming and/or computing position. The user 202 can further hook the first band 106 over the forehead 212 and enjoy a comfortable position and play games for longer duration of time with ease.

Figure 2E:
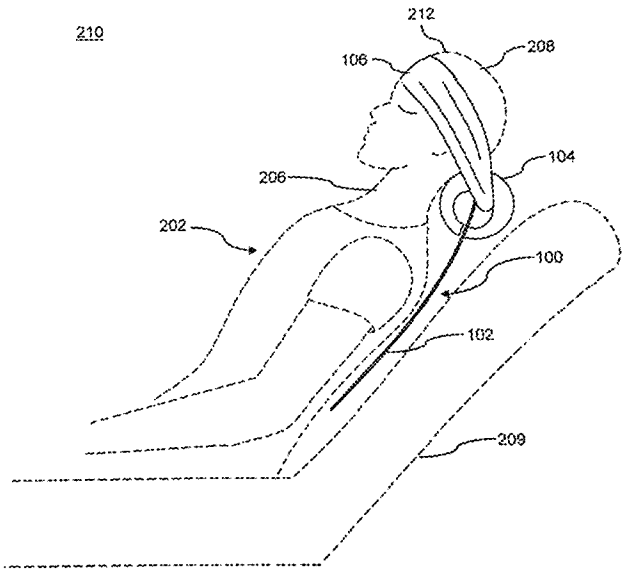
FIG. 2E illustrates another side perspective view of the user wearing the comfort device in a recovery position, according to another embodiment of the present disclosure.

FIG. 2E illustrates another side perspective view 214 of the user 202 wearing the comfort device 100 in a recovery position, according to another embodiment of the present disclosure. When the user 202 wears the comfort device 100 in the recovery position, the slide panel 102 may rest against the back 204 of the user 202. Further, the pad 104 and the first band 106 may be adapted to provide a restful comfort to the neck 206 and the head 208, respectively, of the user 202. In an exemplary scenario, while travelling and/or recovering, the user 202 may place the slide panel 102 between the back 202 and the seat 209 on which the user 202 may be sitting. The slide panel 102 may be flexible such that the slide panel 102 can adjust to individual shapes and forms of the back of the user using the comfort device 100 while sitting on the seat 209 while travelling and/or recovering. The user 202 can further hook the first band 106 over the forehead 212 of the user 202 and enjoy a comfortable position for rest and relaxation while the seat 209 is reclined.

Figure 2F:
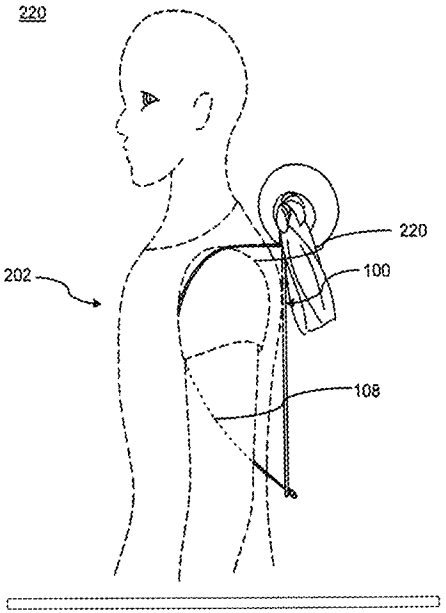
FIG. 2F illustrates a front view of the user carrying the comfort device, according to an embodiment of the present disclosure.

FIG. 2F illustrates a front view 220 of the user 202 carrying the comfort device 100, according to an embodiment of the present disclosure. As illustrated, the user 202 can carry the comfort device 100 by way of the second band 108. Specifically, the user 202 may wear the comfort device 100 over a shoulder 220 of the user 202 by way of the second band 108 that may be attached along a length of the slide panel 102 thus creating a shoulder harness that facilitates the user to carry the comfort device 100 such that the pad 104 flexes downward and conforms when the user 202 carries the comfort device 100.

Thus, the comfort device 100 of the present disclosure may facilitate multifunctional uses such as, but not limited to, travel, meditation, gaming, and recovery. For example, while travelling, a user may place the slide panel 102 between the back of the user and a seat on which the user is sitting. The user can further hook the first band 106 over the forehead and enjoy a comfortable position for rest, relaxation, and/or napping. Similarly, for meditation and/or gaming, the slide panel 102 of the comfort device 100 may facilitate for head and neck support, thus providing comfort and better posture when sitting erect for longer duration of time. For recovery, a user unable to sleep while lying down due to discomfort, the comfort device 100 may provide a safe position to rest while sitting in an upright position. Moreover, the comfort device 100 may be designed in such a way that each component (i.e., the slide panel 102, the pad 104, the first band 106, and the second hand 108) is flexible and supportive in way that provides restful comfort for a back, a neck, and a head of a user using the comfort device 100. Further, each component (i.e., the slide panel 102, the pad 104, the first band 106, and the second band 108) is hand washable. Specifically, unlike other devices known in the prior art, the comfort device 100 does not require any extension and/or separate parts. Further, the comfort device

100 is one size fits all devices. The simplicity and form of the slide panel 102 needs only reach a pressure of the user's shoulder blades against a chair back to benefit from its function.

While various embodiments of the present disclosure have been illustrated and described, it will be clear that the present disclosure is not limited to these embodiments only. Numerous modifications, changes, variations, substitutions, and equivalents will be apparent to those skilled in the art, without departing from the spirit and scope of the present disclosure, as described in the claims. Further, unless stated otherwise, terms such as "first" and "second" are used to arbitrarily distinguish between the elements such terms describe. Thus, these terms are not necessarily intended to indicate temporal or other prioritization of such elements.

I claim:

1. A comfort device comprising:

a slide panel having first and second panel ends;

a pad attached to the first panel end of the slide panel, wherein the pad has first and second pad ends such that (i) the first pad end is fixedly attached to a first surface of the slide panel to form a through cavity and (ii) the second pad end is a free end;

a first band that is inserted into the through cavity; and a second band that is attached to the first and second panel ends.

2. The comfort device of claim 1, wherein the first panel end and the second panel end comprising a first panel hole and a second panel hole, respectively, such that the second band is attached to the first and second panel ends by way of the first and second panel holes, respectively.

3. The comfort device of claim 1, wherein the slide panel is made up of acrylonitrile butadiene styrene (ABS) plastic material.

4. The comfort device of claim 1, wherein the slide panel has (i) a thickness of 0.125 inches, (ii) a length (L1) in a range of 12 inches to 18 inches, and (iii) a width (W1) in a range of 3 inches to 5 inches.

5. The comfort device of claim 1, wherein the slide panel has rounded edges.

6. The comfort device of claim 1, wherein the pad is made up of a cellulose material.

7. The comfort device of claim 1, wherein the pad has an inner diameter (ID) and an outer diameter (OD) such that the inner diameter (ID) is less than the outer diameter (OD).

8. The comfort device of claim 1, wherein the inner diameter (ID) is in a range of 1.5 inches to 2 inches and the outer diameter is in a range of 3 inches to 3.5 inches.

9. The comfort device of claim 1, wherein the pad has a width (W2) that is in a range of 3 inches to 5 inches.

10. The comfort device of claim 1, wherein the first band has a tapering width in a range of 2 inches to 4 inches and a length in a range of 25 inches to 35 inches.

11. The comfort device of claim 1, wherein the pad has a cutout that is formed between the first and second pad ends such that the cutout is adapted to receive the first panel end for attaching the slide panel to the pad.

12. The comfort device of claim 1, wherein the first band comprising first and second ends such that the first and second ends, when attached to one another form a closed loop.

13. The comfort device of claim 12, further comprising an attachment adapted to (i) attach the first and second ends of the first band and (ii) enable an adjustment of a diameter of the closed loop.

14. The comfort device of claim 1, wherein a weight of the comfort device is in a range of 0.5 ounces to 0.6 ounces.

* * * * *